US010808326B2

(12) United States Patent
Simmons et al.

(10) Patent No.: US 10,808,326 B2
(45) Date of Patent: Oct. 20, 2020

(54) ANODE SUPPORT DEVICE FOR CATHODIC PROTECTION OF METAL REINFORCEMENT

(71) Applicant: DE NORA TECH, LLC, Concord, OH (US)

(72) Inventors: Robert Simmons, Mentor, OH (US); Thomas Turk, Painesville, OH (US)

(73) Assignee: DE NORA TECH, LLC, Concord, OH (US)

( * ) Notice: Subject to any disclaimer, the term of this patent is extended or adjusted under 35 U.S.C. 154(b) by 393 days.

(21) Appl. No.: 15/903,268

(22) Filed: Feb. 23, 2018

(65) Prior Publication Data

US 2019/0264336 A1 Aug. 29, 2019

(51) Int. Cl.
*C23F 13/18* (2006.01)

(52) U.S. Cl.
CPC ..... *C23F 13/18* (2013.01); *C23F 2201/02* (2013.01)

(58) Field of Classification Search
CPC ..... C23F 13/18; C23F 2201/02; C23F 13/06; C23F 13/10; C23F 13/14; C23F 2213/22; C23F 13/04; C23F 13/12; C23F 13/20; C23F 2213/30; C04B 2111/265; E04C 5/203; F16L 3/1075; F16L 3/12; F16L 3/233; F16L 33/035; Y10T 24/1498; Y10T 24/1482; Y10T 24/44752; Y10T 24/44248; F04D 7/06; F05D 2260/95
See application file for complete search history.

(56) References Cited

U.S. PATENT DOCUMENTS 5,531,873 A 7/1996 Pulliainen et al.
7,451,579 B2 * 11/2008 Azarin ..... E04C 5/203 248/74.3

FOREIGN PATENT DOCUMENTS

| | | |
|---|---|---|
| EP | 0 262 835 A1 | 4/1988 |
| EP | 0 407 348 A1 | 1/1991 |
| EP | 0 534 392 A1 | 3/1993 |
| WO | 2012/035167 A2 | 3/2012 |

* cited by examiner

*Primary Examiner* — Xiuyu Tai
(74) *Attorney, Agent, or Firm* — Renner, Otto, Boisselle & Sklar, LLP

(57) ABSTRACT

A spacer element is provided to support an anode on a metallic reinforcement bar, such as a rebar. The spacer element includes a bar supporting body and an adjustable fastening body that are integrally formed, and a separate anode supporting body that is connectable to the bar supporting body. The bar supporting body includes a circumferential wall having resilient tines that extend radially inwardly to engage the rebar. The adjustable fastening body includes a toothed rib that is engageable with a toothed portion of the circumferential wall to contract the circumferential wall securely around the inserted rebar. The rib may be disengaged from the circumferential wall to open the wall and enable insertion of the rebar. The anode supporting body has a resilient prong that is rotatable when received in the bar supporting body enabling the anode supporting body to be rotatable relative to the bar supporting body.

20 Claims, 5 Drawing Sheets

ANODE SUPPORT DEVICE FOR CATHODIC PROTECTION OF METAL REINFORCEMENT

FIELD OF INVENTION

The present invention relates to the corrosion protection of metallic reinforcement bars used in concrete structures.

BACKGROUND

Metallic components, such as steel, may be used to reinforce structures in various applications. For example, reinforcing steel bars, also known as rebars, may be advantageously used in concrete structures due to the compressive strength of concrete and the tensile strength of steel. Reinforced concrete structures may be used in many applications, such as in bridge decks and in parking garages. However, reinforcing steel may deteriorate over time due to corrosion caused by the use of road salt and coastal construction.

Anodes may be used for cathodic protection of the reinforcing steel. The anodes may be embedded within the concrete to distribute current to the metallic elements that require protection. An ionic charge through the concrete occurs between the anode and the metallic elements due to a current supplied from a power source. The charge results in cathodic polarization of the metallic elements such that corrosion of the metallic elements is prevented. However, contact or near-contact between the anode and the cathode may result in short-circuiting that prevents current flow. Therefore, anode-to-cathode contact must be prevented within the structure.

Prior attempts to prevent anode-to-cathode contact have included using polymeric overlays. However, using overlays may be disadvantageous in that manufacturing the overlays is complex and the overlays may not fully prevent anode-to-cathode contact.

SUMMARY OF INVENTION

The present invention is directed towards a spacer element that supports an anode member and a metallic reinforcement bar, such as a rebar, while maintaining a predetermined space therebetween. The spacer element is configured to accommodate rebars having various sizes using a bar supporting body having resilient tines and an adjustable fastening body. The tines extend radially inwardly from the bar supporting body to bite onto a rebar that is inserted through the bar supporting body. The adjustable fastening body has a toothed rib engageable with a toothed portion of the bar-supporting body. The teeth are meshingly engageable to contract the bar-supporting body securely around the inserted rebar. The rib may be disengaged from the ring-shaped body to open the ring-shaped body and enable radial insertion of the rebar. The spacer element further includes an anode supporting body that is disconnectable from the ring-shaped body and rotatable relative to the bar supporting body when connected thereto.

According to an aspect of the invention, a spacer element is used for supporting an anode member on a metallic reinforcement bar. The spacer element includes a main body defining an aperture through which the metallic reinforcement bar is received. The main body has a circumferential wall and a plurality of resilient tines that extend radially inwardly from the circumferential wall into the aperture to engage the metallic reinforcement bar. The circumferential wall has a first connecting portion and a second connecting portion that are adjacent. The first connecting portion and the second connecting portion are engageable and disengageable to contract and expand the circumferential wall respectively, and the metallic reinforcement bar is radially insertable between the first connecting portion and the second connecting portion and into the aperture when the circumferential wall is expanded. The spacer element further includes an anode supporting body that is connectable to the main body and is configured to retain the anode member.

According to another aspect of the invention, a spacer element is used for supporting an anode member on a metallic reinforcement bar. The spacer element includes a main body having a circumferential wall that defines an aperture through which the metallic reinforcement bar is received and a fastening body that is connected to the main body. The circumferential wall has a first connecting portion and a second connecting portion that are adjacent, and the first connecting portion and the second connecting portion are engageable and disengageable to close and open the circumferential wall respectively. The fastening body includes a first rib spaced radially outwardly from the first connecting portion to define a first teeth receiving slot between the first rib and the circumferential wall. The first rib has a first plurality of teeth extending radially inwardly from the first rib into the first teeth receiving slot, and the second connecting portion of the circumferential wall has a second plurality of teeth that extends radially outwardly from the circumferential wall and is engageable with the first plurality of teeth. The fastening body further includes a second rib spaced radially outwardly from the second connecting portion of the circumferential wall to define a second teeth receiving slot between the second rib and the circumferential wall. The first rib is reciprocally inserted into the second teeth receiving slot when the second connecting portion is inserted into the first teeth receiving slot. The support element further includes an anode supporting body that is connectable to the main body and is configured to retain the anode member.

According to still another aspect of the invention, a spacer element is used for supporting an anode member on a metallic reinforcement bar. The spacer element includes a bar supporting body having a wall that defines an aperture through which the metallic reinforcement bar is received and a through-hole therethrough. The spacer element further includes an anode supporting body that is connectable to the bar supporting body and the anode supporting body includes a main body having a first planar surface facing the wall of the bar supporting body, and a second planar surface that opposes the first planar surface. The anode supporting body further includes a pivotable arm that is hinged to the second planar surface and is spaced from the second planar surface to define an anode receiving slot between the pivotable arm and the second planar surface, and a resilient prong that extends from the first planar surface toward the bar supporting body. The resilient prong is insertable through the through-hole and rotatable within the through-hole when inserted, whereby the anode supporting body is rotatable relative to the bar supporting body.

Other systems, devices, methods, features, and advantages of the present invention will be or become apparent to one having ordinary skill in the art upon examination of the following drawings and detailed description. It is intended that all such additional systems, methods, features, and advantages be included within this description, be within the scope of the present invention, and be protected by the accompanying claims.

DETAILED DESCRIPTION

Aspects of the present invention relate to cathodic protection devices that may be suitable for use in applications using concrete structures that have metallic reinforcement, and in particular to a spacing element for supporting an anode member from a metallic reinforcement bar on which the anode member is mounted or supported. The spacing element described herein may be suitable for use in concrete structures that are steel-reinforced. Examples of suitable applications that use steel-reinforced concrete structures include bridge decks, parking garages, piers, and pedestrian walkways. Other examples of possible applications include various substructures such as supporting structures and support columns. The spacing element may be suitable for use in many other applications.

Figure 1:
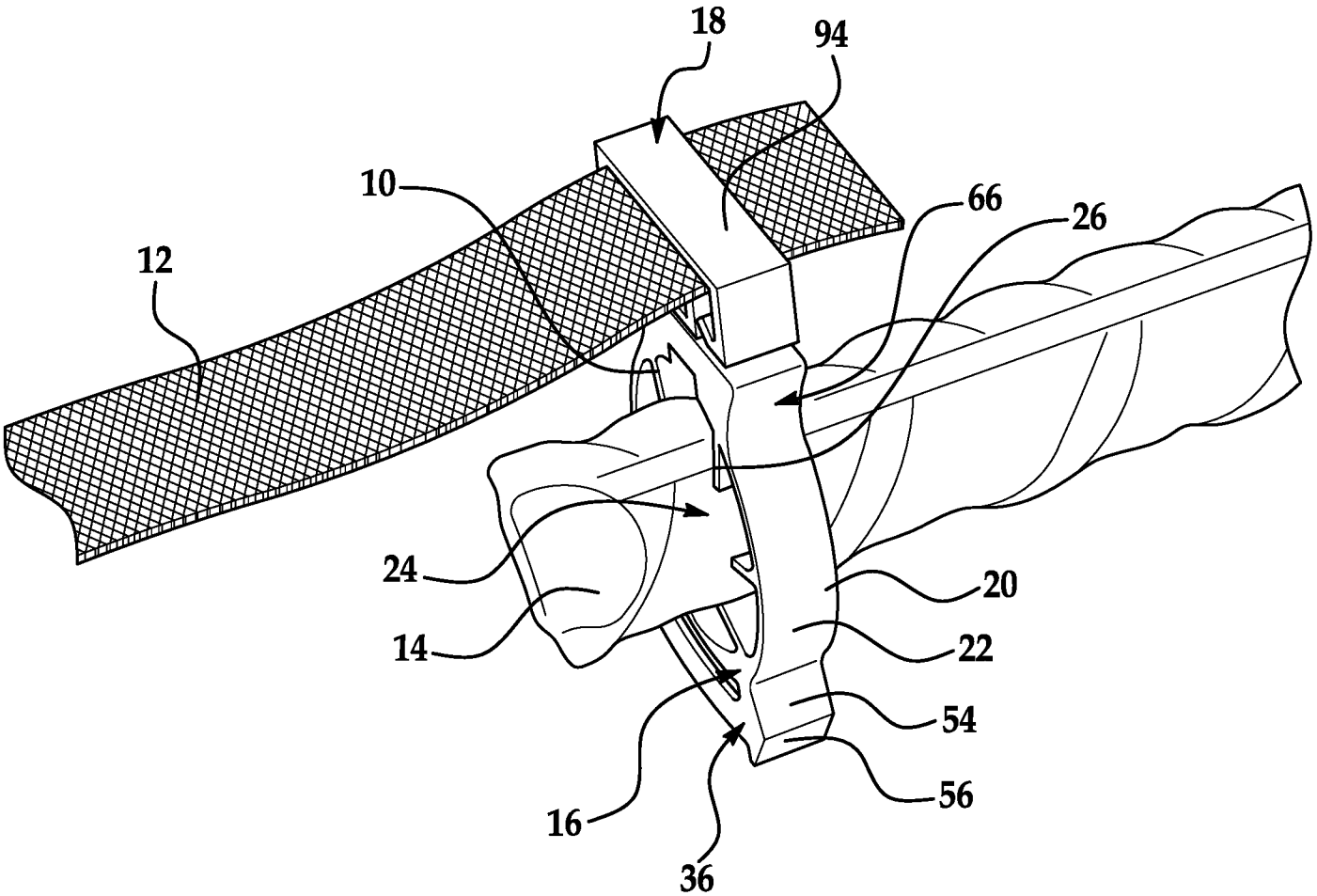
FIG. 1 is a sectional view of a spacer element supporting an anode member on a metallic reinforcement bar.

Referring first to FIG. 1, a spacer element 10 for supporting an anode member 12 on a metallic reinforcement bar 14 is shown. The anode member 12 may have any suitable shape. An example of a suitable shape is a substantially flat sheet. The anode member 12 may be in the form of a flat sheet of valve metal mesh having a diamond-shaped pattern. The anode member 12 may be formed of titanium, tantalum, zirconium, niobium, or any other suitable metals, or alloys thereof. Current may be distributed to the anode member 12 by way of a valve metal current distribution member (not shown) that is metallurgically bonded to the valve metal strands. A power source (not shown), such as a DC power source having terminals, may be electrically connected to the anode member 12 and to the metallic reinforcement bar 14.

The metallic reinforcement bar 14 may be reinforced with any suitable metal, such as steel. The metallic reinforcement bar 14 may be a cylindrical or rod-shaped body having a longitudinal axis. The metallic reinforcement bar 14 may be one of a plurality of metallic reinforcement bars that form a rebar cage used in a larger reinforced concrete structure. The spacer element 10 is generally arranged between the anode member 12 and the metallic reinforcement bar 14 to maintain a predetermined space between the anode member 12 and the metallic reinforcement bar 14 within the concrete structure.

Referring in addition to FIGS. 2-5, the spacer element 10, 10' has a bar supporting body 16 that receives the metallic reinforcement bar 14 and an anode supporting body 18 that receives the anode member 12. The bar supporting body 16 has a main body 20 that is substantially cylindrical or ring-shaped. The main body 20 has a circumferential wall 22 defining an aperture 24 through which the metallic reinforcement bar 14 extends when the metallic reinforcement bar 14 is inserted into the spacer element 10, 10'. The spacer element 10, 10' may be arranged, or clipped onto the metallic reinforcement bar 14. The circumferential wall 22 may circumscribe the longitudinal axis of the inserted metallic reinforcement bar 14.

The circumferential wall 22 has a plurality of resilient tines 26 that extend radially inwardly from an interior surface 28 of the circumferential wall 22 that faces the aperture 24. The resilient tines 26 extend radially inwardly into the aperture 24 to engage or bite into the inserted metallic reinforcement bar 14. The resilient tines 26 is flexible to accommodate metallic reinforcement bars having different diameters. Any suitable number of resilient tines 26 may be provided and the resilient tines 26 may be equidistantly spaced along the interior surface 28. For example, five or six resilient tines 26 may be suitable. The resilient tines 26 may each have the same dimensions, or lengths, widths, and thicknesses. The resilient tines 26 may be integrally formed with the circumferential wall 22 such that the width of the resilient tines 26 may be the same as the width of the circumferential wall 22.

The circumferential wall 22 further includes a first connecting portion 30 and a second connecting portion 32 that is adjacent the first connecting portion 30 along the circumference of the circumferential wall 22. The circumferential wall 22 may include a gap 34 defined between the first connecting portion 30 and the second connecting portion 32. The first connecting portion 30 and the second connecting portion 32 are engageable and disengageable with each other to close and open the gap 34 respectfully. The first connecting portion 30 and the second connecting portion 32 are moveable toward and away from each other to contract and expand the circumferential wall 22 respectfully. The metallic reinforcement bar 14 is radially insertable between the first connecting portion 30 and the second connecting portion 32 and through the gap 34 when the first connecting portion 30 and the second connecting portion 32 are moved away from each other to open the gap 34. The metallic reinforcement bar 14 may be radially inserted through the gap 34 and into the aperture 24 for engagement with the plurality of tines 26.

When the metallic reinforcement bar 14 is inserted, the spacer element 10, 10' further includes a fastening body 36 that is connected to the main body 20 and is adjustable for tightening the main body 20 around the metallic reinforcement bar 14. The fastening body 36 has a first rib 38 that extends circumferentially along the first connecting portion 30 of the circumferential wall 22 and is spaced radially outwardly from the first connecting portion 30. The first connecting portion 30 and the first rib 38 define a first teeth receiving slot 40 between the first rib 38 and the circumferential wall 22. The first rib 38 has a first plurality of teeth 42 extending radially inwardly from the first rib 38 into the first teeth receiving slot 40. The first plurality of teeth 42 may include ridges that extend along the entire width of the first rib 38. The first plurality of teeth 42 may be arranged along an entire length of the first teeth receiving slot 40 and an entire length of the first rib 38.

The first plurality of teeth 42 are engageable with a second plurality of teeth 44 formed on the second connecting portion 32 of the circumferential wall 22. The second plurality of teeth 44 extends radially outwardly for meshing engagement with the first plurality of teeth 42 when the second connecting portion 32 is inserted into the first teeth receiving slot 40. A second teeth receiving slot 46 may be defined between the second connecting portion 32 and a second rib 48 formed on the fastening body 36. The second rib 48 may extend circumferentially along the second connecting portion 32 of the circumferential wall 22 and is spaced radially outwardly from the second connecting portion 32 to define the second teeth receiving slot 46 therebetween. The second plurality of teeth 44 may extend radially outwardly from the second connecting portion 32 into the second teeth receiving slot 46. The second plurality of teeth 44 may include ridges that extend along the entire width of the second connecting portion 32. The second plurality of teeth 44 may be arranged along an entire length of the second teeth receiving slot 46 and an entire length of the second connecting portion 32.

The circumferential wall 22 may be expanded or contracted via the mutual insertion of the second connecting portion 32 into the first teeth receiving slot 40 and the first rib 38 into the second teeth receiving slot 46. When the circumferential wall 22 is closed, the first connecting portion 30 and the second connecting portion 32 are fastened together via the engagement of the teeth. Using the engaging teeth is advantageous because the first connecting portion 30 and the second connecting portion 32 cannot be easily disengaged by only pulling the first connection portion 30 and the second connecting portion 32 directly away from each other. The first rib 38 is reciprocally inserted into the second teeth receiving slot 46 when the second connecting portion 32 is inserted into the first teeth receiving slot 40 such that the first plurality of teeth 42 meshingly engage with the second plurality of teeth 44.

Using the toothed first rib 38 and the toothed second connecting portion 32 is also advantageous because the fastening body 36 is adjustable and the circumferential wall 22 may be extended in diameter or contracted in diameter to accommodate for metallic reinforcement bars 14, or rebars, having different diameters. For example, the first plurality of teeth 42 and the second plurality of teeth 44 may be pushed toward each other for the engagement of more teeth, such that the diameter of the circumferential wall 22 is decreased to more securely support a metallic reinforcement bar 14 having a smaller diameter. In contrast, the first plurality of teeth 42 and the second plurality of teeth 44 may be moved away from each other to decrease the number of teeth that are engaged, such that the diameter of the circumferential wall 22 is increased to more securely support a metallic reinforcement bar 14 having a larger diameter.

Figure 2:
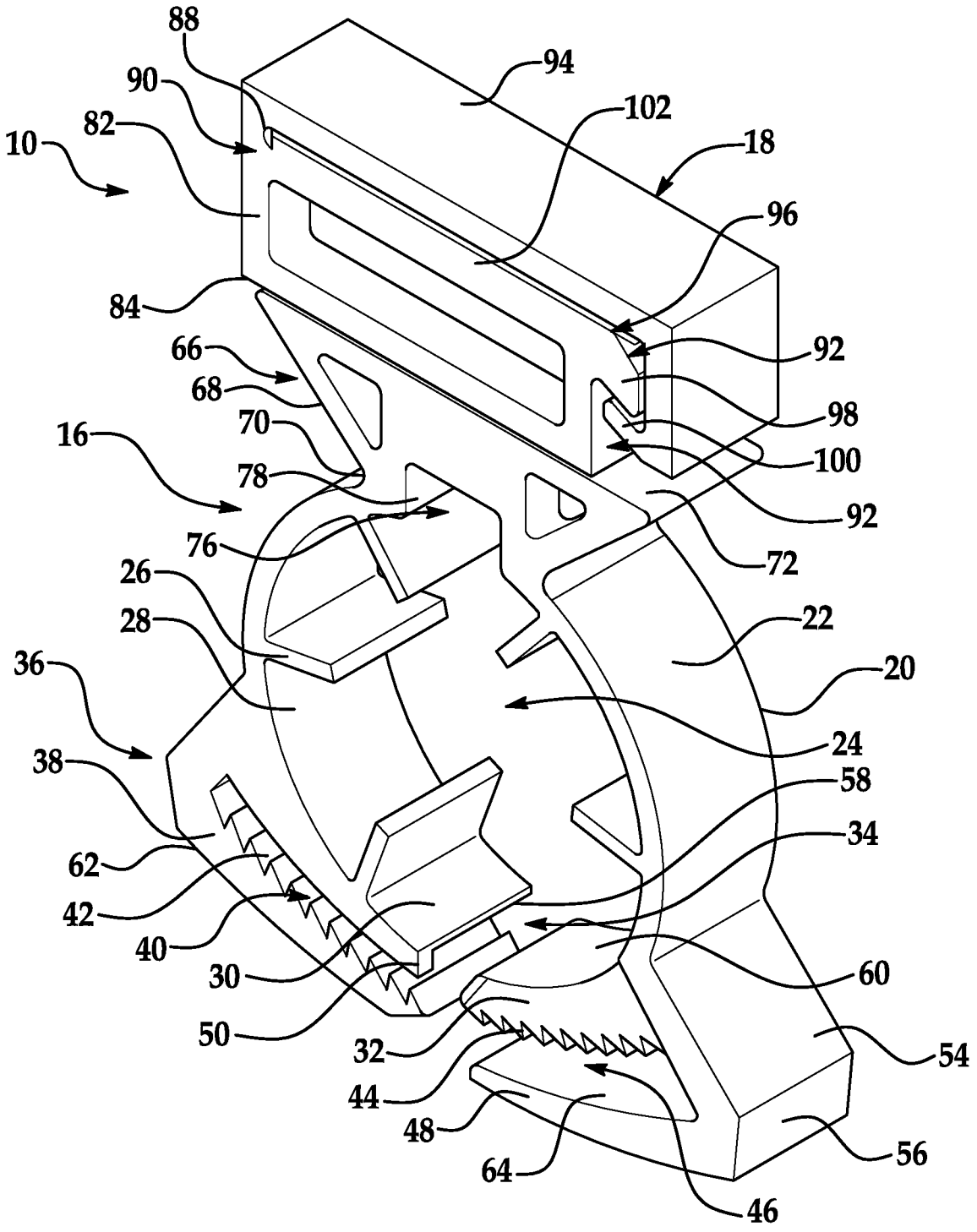
FIG. 2 is a sectional view of the spacer element shown in FIG. 1 according to a first embodiment.
Figure 3:
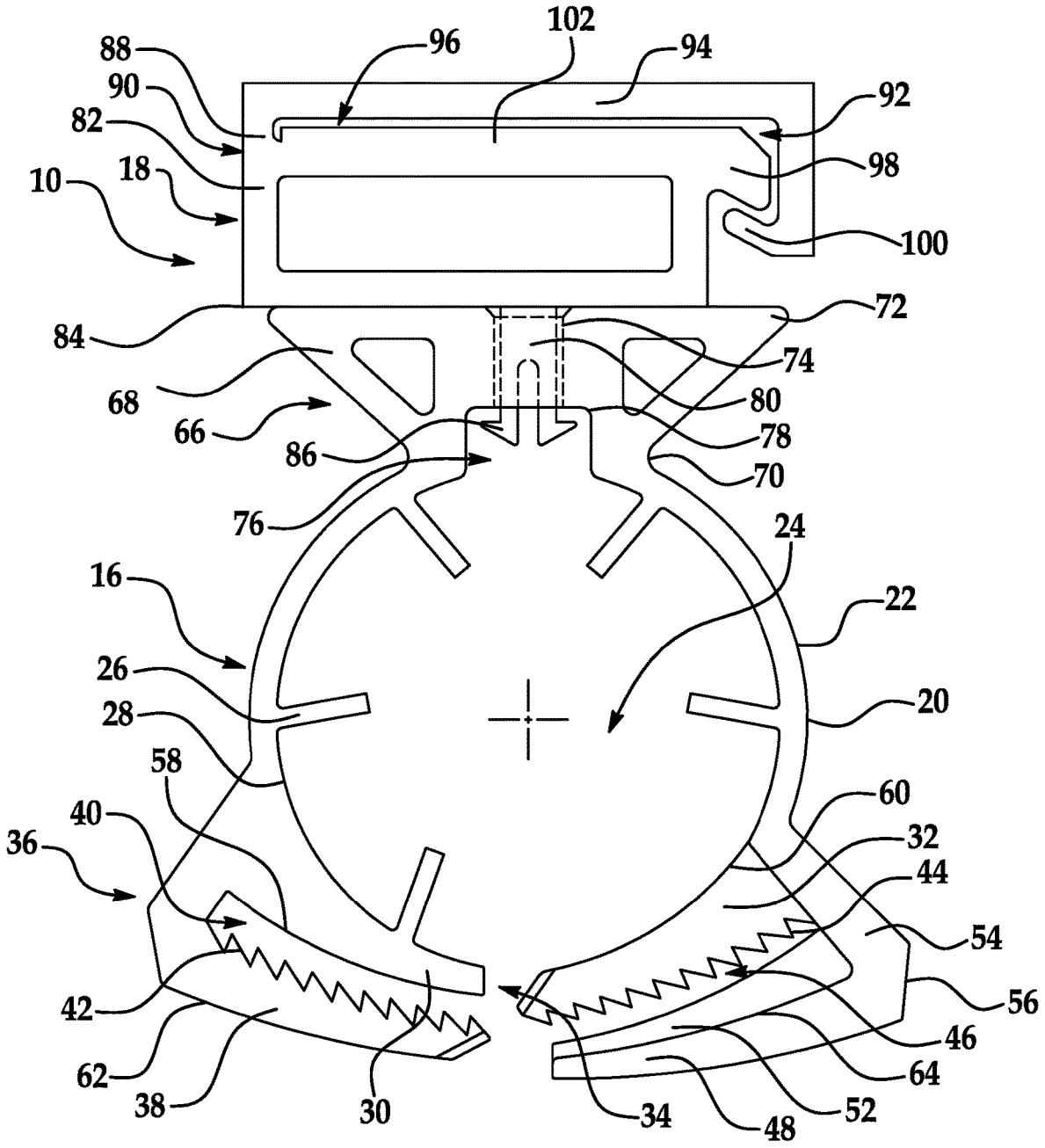
FIG. 3 is a front view of the spacer element shown in FIG. 2.

Disengaging the first connecting portion 30 and the second connecting portion 32 may be achieved by axially moving the first connecting portion 30 and the second connecting portion 32 such that the first plurality of teeth 42 and the second plurality of teeth 44 slide through each other in an axial direction. Radially extending ridges may also be provided to limit or prevent axial movement of the first connecting portion 30 and the second connecting portion 32 when engaged. With reference to FIGS. 2 and 3, a first embodiment of the spacer element 10 may include a first ridge 50 that is arranged on the first connecting portion 30 and a second ridge 52 that is arranged on the second rib 48.

As best shown in FIG. 2, the first ridge 50 is arranged on an edge of the first connecting portion 30 and extends radially outwardly into the first teeth receiving slot 40. The first ridge 50 may extend along the entire length of the first connecting portion 30 and along the entire length of the first teeth receiving slot 40. The second connecting 32 may be engageable against the first ridge 50 in a first axial direction when the second connecting portion 32 is inserted into the first teeth receiving slot 40, such that the first ridge 50 prevents further axial movement of the second connecting portion 32 in the first axial direction. The second connecting portion 32 may be disengageable from the first connecting portion 30 via axially moving the second connecting portion 32 in a second axial direction that is opposite the first axial direction.

As best shown FIG. 3, the second ridge 52 is arranged on an edge of the second rib 48 and extends radially inwardly into the second teeth receiving slot 46. The second ridge 52 may extend along the entire length of the second rib 48 and along the entire length of the second teeth receiving slot 46. The height of the second ridge 52 may increase along the length of the second rib 48. The first rib 38 may be engageable against the second ridge 52 in the second axial direction when the first rib 38 is inserted into the second teeth receiving slot 46, such that the second ridge 52 prevents further axial movement of first rib 38 in the second axial direction. The first connecting portion 30 may be disengageable from the second connecting portion 32 via axially moving the first rib 38 in the first axial direction. Accordingly, the first connecting portion 30 and the second connecting portion 32 may only be disengageable by pulling the portions 30, 32 in opposite axial directions relative to each other.

Figure 4:
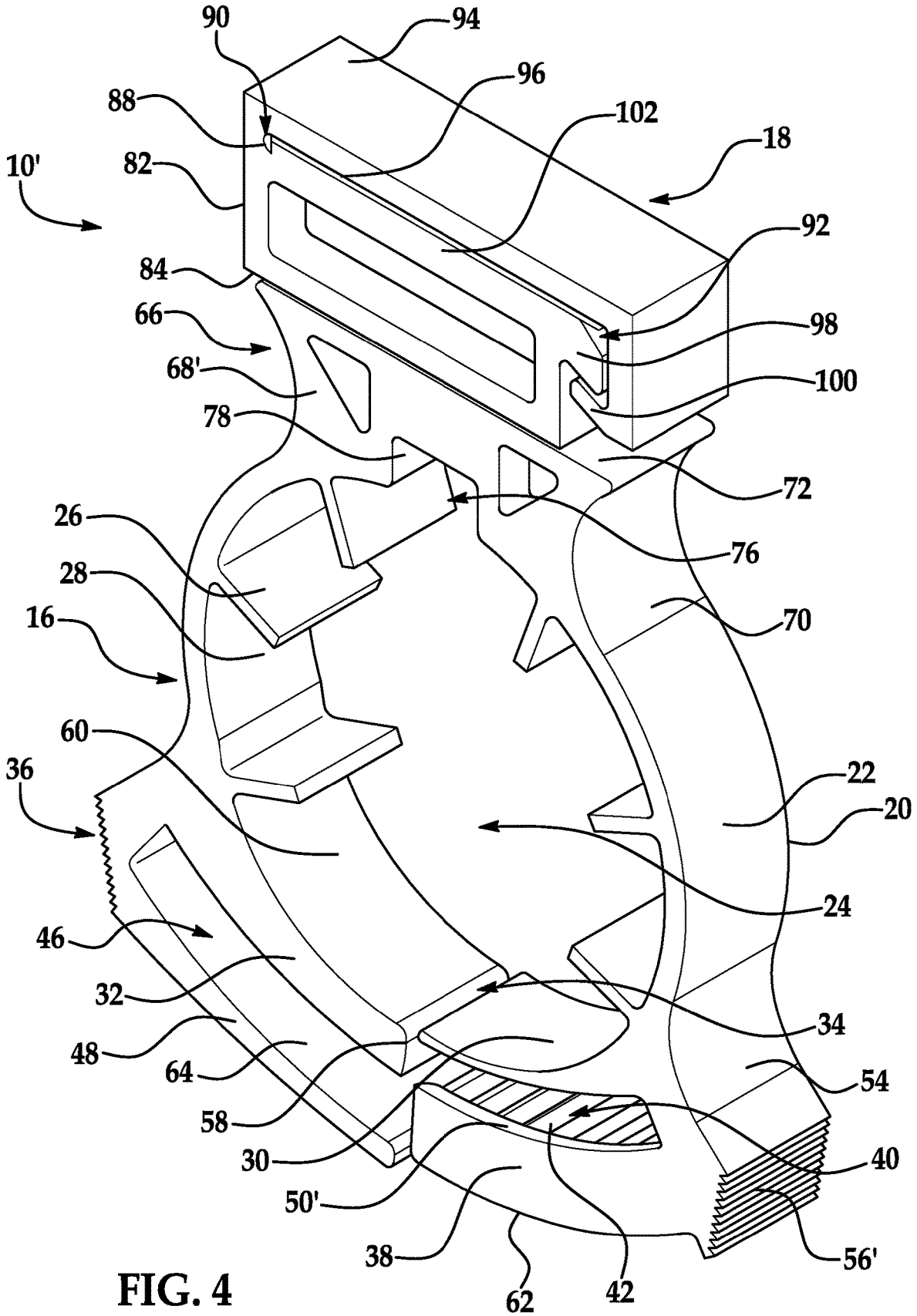
FIG. 4 is a sectional view of the spacer element shown in FIG. 1 according to a second embodiment.
Figure 5:
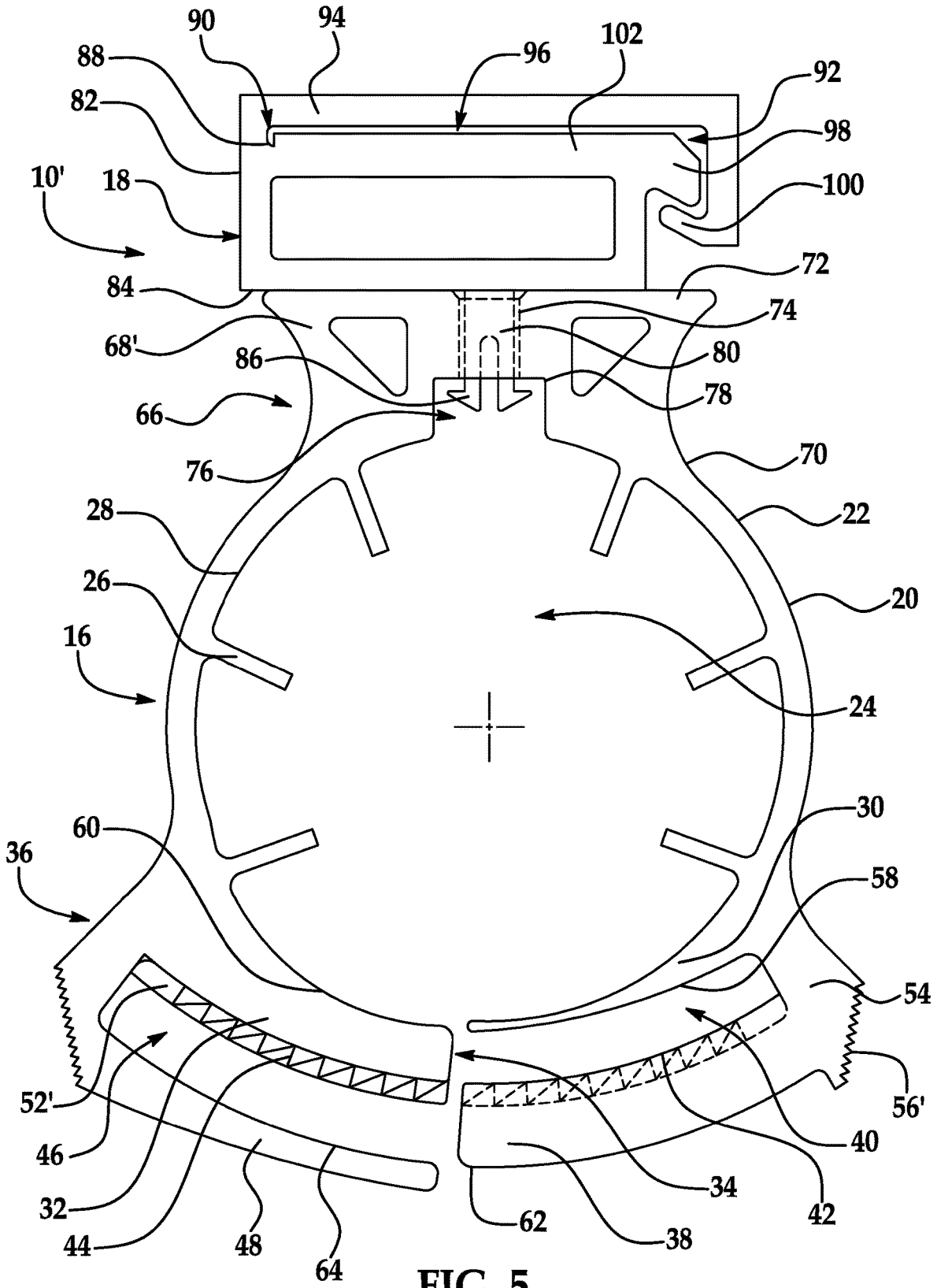
FIG. 5 is a front view of the spacer element shown in FIG. 4.

Referring now to FIGS. 4 and 5, a second embodiment of the spacer element 10' may include a first ridge 50' that is arranged on an edge of the first rib 38 and a second ridge 52' that is arranged on an edge of the second connecting portion 32. As best shown in FIG. 4, the first ridge 50' may extend along the entire length of the first rib 38 and along the entire length of the first teeth receiving slot 40. The second connecting 32 may be engageable against the first ridge 50' in a first axial direction when the second connecting portion 32 is inserted into the first teeth receiving slot 40, such that the first ridge 50' prevents further axial movement of the second connecting portion 32 in the first axial direction. The first ridge 50' may be adjacent to the first plurality of teeth 42 and the second plurality of teeth 44. The second connecting portion 32 may be disengageable from the first connecting portion 30 via axially moving the second connecting portion 32 in a second axial direction that is opposite the first axial direction.

As best shown FIG. 5, the second ridge 52' is arranged on the second connecting portion 32 and extends radially outwardly into the second teeth receiving slot 46. The second ridge 52' may extend along the entire length of the second connecting portion 32 and along the entire length of the second teeth receiving slot 46. The first rib 38 may be engageable against the second ridge 52' in the second axial direction when the first rib 38 is inserted into the second teeth receiving slot 46, such that the second ridge 52' prevents further axial movement of first rib 38 in the second axial direction. The first connecting portion 30 may be disengageable from the second connecting portion 32 via axially moving the first rib 38 in the first axial direction.

Referring again to FIGS. 2-5, the fastening body 36 may be formed integrally and continuously with the main body 20 such that the fastening body 36 and the main body 20 are formed as a unitary component. The fastening body 36 has walls 54 that extend outwardly from the circumferential wall 22. The walls 54 may be continuous with the circumferential wall 22 and the ribs 38, 48. The first rib 38 and the second rib 48 extend transversely from ends 56, 56' of the walls 54 and toward each other. As shown in the second exemplary embodiment of FIGS. 4 and 5, the ends 56' may be toothed enabling a user to more easily grip the spacer element 10'. The first connecting portion 30 and the second connecting portion 32 also extend transversely from the walls 54 and toward each other such that the teeth receiving slots 40, 46 also extend transversely from the walls 54 and toward each other.

The first and second connecting portions 30, 32 generally extend circumferentially about the circumference of the circumferential wall 22 and are moveable toward and away from each other. The first and second ribs 38, 48 generally extend along a circumference that is greater than the circumference of the circumferential wall 22 and are also moveable toward each other. The first connecting portion 30 and the first rib 38 are coupled for uniform movement and the second connecting portion 32 and the second rib 48 are coupled for uniform movement. Furthermore, when the first plurality of teeth 42 and the second plurality of teeth 44 are in engagement, a bottom surface 58 of the first connecting portion 30 overlaps with a top surface 60 of the second connecting portion 32 and a bottom surface 62 of the first rib 38 overlaps with a top surface 64 of the second rib 48. Thus, when the teeth are engaged and the ribs and the connecting portions are overlapping, the fastening body 36 is fastened and the spacer element 10, 10' is secured around the metallic reinforcement bar 14.

The bar supporting body 16 may further include an anode connecting portion 66 that is connected between the main body 20 and the anode supporting body 18. The anode connecting portion 66 may be integrally formed and continuous with the main body 20. The anode connecting portion 66 may be arranged at an opposite end of the main body 20 relative to the fastening body 36. The anode connecting portion 66 extends radially outwardly from the main body 20 toward the anode supporting body 18. The anode connecting portion 66 may have a body 68, 68' with any suitable shape. For example, as shown in the first embodiment of FIGS. 2 and 3, the anode connecting portion 66 may be triangularly shaped such that the body 68 of the anode connecting portion 66 tapers inwardly from the anode supporting body 18 to a point 70 along the circumferential wall 22 where the body 68 meets the circumferential wall 22. As shown in the second embodiment of FIGS. 4 and 5 the body 68' may be curved or necked.

In any embodiment, the anode connecting portion 66 may be continuous with the circumferential wall 22. The anode connecting portion 66 has a planar surface 72 and a through-hole 74 that extends from the planar surface 72 and through the body 68, 68', as best shown by the phantom lines in FIGS. 3 and 5. The through-hole 74 extends to a prong end receiving cavity 76 that is defined by planar wall members 78 of the body 68. The prong end receiving cavity 76 may have any suitable shape. An example of a suitable shape is rectangular. The prong end receiving cavity 76 opens to the aperture 24 of the main body 20.

The through-hole 74 is configured to receive a resilient prong 80, as shown by phantom lines in FIGS. 3 and 5, of the anode supporting body 18 for connecting the anode supporting body 18 to the main body 20. The anode supporting body 18 and the main body 20 may use any suitable male to female connectors or quick connectors. Many other types of connectors or fastening mechanisms may also be suitable. The anode supporting body 18 may have any suitably shaped protrusion for insertion into the main body 20. In an alternative embodiment, the protrusion or resilient prong 80 may be arranged on the main body 20 and the through-hole 74 may be arranged on the anode supporting body 18.

The anode supporting body 18 may be connected to and disconnected from the main body 20. The anode supporting body 18 has a main body which may be a rectangular body 82 having a first planar surface 84 from which the resilient prong 80 extends outwardly toward the main body 20. The main body may any other suitable shape. The first planar surface 84 of the rectangular body 82 is arranged to face the planar surface 72 of the anode connecting portion 66. As best shown in FIGS. 3 and 5, the resilient prong 80 has an end with flanged projections 86 to be inserted into the through-hole 74. The flanged projections 86 are forced inwardly toward each other when the end of the resilient prong 80 is inserted through the through-hole 74. When the end of the resilient prong 80 leaves the through-hole 74 and enters the prong end receiving cavity 76, the flanged projections 86 resiliently move outwardly from each other.

When the resilient prong 80 is inserted into the main body 20, the flanged projections 86 are engageable against at least one of the planar wall members 78 that faces the aperture 24 to prevent the resilient prong 80 from easily being pulled out of the through-hole 74. The resilient prong 80 may be pulled back through the through-hole 74 via a greater force than used to insert the resilient prong 80 into the through-hole 74. The through-hole 74 has a diameter that is larger than the body of the resilient prong 80 enabling rotation of the resilient prong 80 within the through-hole 74. Accordingly, the entire anode supporting body 18 may be rotated relative to the main body 20. In an exemplary embodiment, the through-hole 74 and the resilient prong 80 may extend in a direction that is perpendicular to the longitudinal axis of the metallic reinforcement rod 14 (as shown in FIG. 1) such that the anode supporting body 18 is rotatable about an axis that is perpendicular to the longitudinal axis.

Referring again to FIGS. 2-5, the rectangular body 82 further has a second planar surface 88 that opposes the first planar surface 84 and has a first end 90 and a second end 92 opposite the first end 90. The anode supporting body 18 includes a pivotable arm 94 that is hinged to the first end 90 of the second planar surface 88 and extends from the first end 90 to the second end 92. The pivotable arm 94 is pivotable toward and away from the second planar surface 88 and is spaced from the second planar surface 88 to define an anode receiving slot 96 between the pivotable arm 94 and the second planar surface 88. The second end 92 of the second planar surface 88 may be formed as a ledge 98 and the second the pivotable arm 94 may have a hooked portion or a hook 100 that is opposite the hinged end of the pivotable arm 94 and extends around the ledge 98 to surround the ledge 98.

The hook 100 is disengageable and engageable with the underside of the ledge 98 for opening and closing the anode receiving slot 96 respectively. When the hook 100 is disengaged from the ledge 98 and the pivotable arm 94 is pivoted away from the second planar surface 88, the anode receiving slot 96 is open and the anode member 12 (as shown in FIG. 1) may be placed in the anode receiving slot 96. The pivotable arm 94 may then be pivoted toward the second planar surface 88 such that the hook 100 can be engaged with the ledge 98 and the anode member 12 is secured within the anode receiving slot 96.

The second planar surface 88 may also have a ridge 102 that extends outwardly from the second planar surface 88 and into the anode receiving slot 96. The ridge 102 may extend along an entire length of the second planar surface 88 from the first end 90 to the second end 92. The ridge 102 may be arranged along an edge of the second planar surface 88. The inserted anode member 12 extends through the anode receiving slot 96 and the ridge 102 engages the anode member 12 to prevent the anode member from being pulled out of the anode receiving slot 96 in an axial direction.

The anode supporting body 18 may be formed as a separate component from the main body 20 and the fastening body 36. The anode supporting body 18, main body 20, and the fastening body 36 may all be formed of the same material and any suitable non-conductive material may be used. Examples of suitable materials include any polymer materials which are electrically non-conductive. Thermosetting polymers or thermoplastic polymers may be used. Examples of suitable thermoplastic materials include polyethylene, polypropylene, polyvinylhalides, polyhalocarbons, and polyesters. The material may be acid resistant. Any suitable manufacturing process to form the components may be used. For example, the components may be formed of injection molded polypropylene.

The spacer element 10, 10' described herein is particularly suited in applications having rebars with various sizes. For example, the spacer element 10, 10' may be suitable for use with rebars having diameters that are 0.375 inches, 0.500 inches, 0.625 inches, 0.750 inches, 0.875 inches, 1.000 inches, and 1.128 inches. By providing both resilient tines and an adjustable fastening body, the spacer element 10, 10' may accommodate any of the rebars. Additionally, providing an anode supporting body that is easily connectable and disconnectable from the bar supporting body is advantageous during assembly of an anode member and rebar, or during replacement of an anode member.

A spacer element is used for supporting an anode member on a metallic reinforcement bar. The spacer element includes a main body defining an aperture through which the metallic reinforcement bar is received. The main body has a circumferential wall and a plurality of resilient tines that extend radially inwardly from the circumferential wall into the aperture to engage the metallic reinforcement bar. The circumferential wall has a first connecting portion and a second connecting portion that are adjacent. The first connecting portion and the second connecting portion are engageable and disengageable to contract and expand the circumferential wall respectively. The metallic reinforcement bar is radially insertable between the first connecting portion and the second connecting portion and into the aperture when the circumferential wall is expanded. The spacer element includes an anode supporting body that is connectable to the main body and is configured to retain the anode member.

The spacer element may include a fastening body that is connected to the main body and has a first rib spaced radially outwardly from the first connecting portion of the circumferential wall to define a first teeth receiving slot between the first rib and the circumferential wall. The first rib has a first plurality of teeth extending radially inwardly from the first rib into the first teeth receiving slot and the second connecting portion of the circumferential wall has a second plurality of teeth that extends radially outwardly from the circumferential wall. The second connecting portion is insertable into the first teeth receiving slot and the second plurality of teeth is engageable with the first plurality of teeth to close the circumferential wall.

The spacer element may include a first ridge that radially extends into the first teeth receiving slot and is arranged on the first connecting portion or on the first rib. The second connecting portion is engageable against the first ridge in one axial direction when the second connecting portion is inserted into the first teeth receiving slot, whereby the first ridge prevents further axial movement of the second connecting portion in the one axial direction.

The first plurality of teeth may be arranged along an entire length of the first teeth receiving slot.

The fastening body may have a second rib spaced radially outwardly from the second connecting portion of the circumferential wall to define a second teeth receiving slot between the second rib and the circumferential wall. The first rib is reciprocally inserted into the second teeth receiving slot when the second connecting portion is inserted into the first teeth receiving slot.

The spacer element may include a second ridge that radially extends into the second teeth receiving slot and is arranged on the second connecting portion or on the second rib. The first rib is engageable against the second ridge in one axial direction when the first rib is inserted into the second teeth receiving slot, whereby the second ridge prevents further axial movement of the first rib in the one axial direction.

The second plurality of teeth may be arranged along an entire length of the second teeth receiving slot.

The fastening body and the main body may be integrally formed as a unitary component.

The anode supporting body may have a resilient prong extending outwardly from the anode supporting body and toward the main body, and the main body defines a through-hole for receiving and retaining the resilient prong. The resilient prong is rotatable within the through-hole, whereby the anode supporting body is rotatable relative to the main body.

The anode supporting body may further include a rectangular body having a first planar surface from which the resilient prong extends outwardly toward the main body and a second planar surface opposing the first planar surface, and a pivotable arm that is hinged to the second planar surface and is spaced from the second planar surface to define an anode receiving slot between the pivotable arm and the second planar surface.

The second planar surface may be formed as a ledge and the pivotable arm may have a hook that is disengageable and engageable with the ledge for opening and closing the anode receiving slot respectively. The anode member is inserted into the anode receiving slot when the hook is disengaged from the ledge and the anode receiving slot is open.

The second planar surface may have a ridge extending outwardly from the second planar surface and into the anode receiving slot to engage the anode member and prevent axial movement of the anode member.

The main body may include an anode connecting portion that extends radially outwardly from the main body toward the anode supporting body. The anode connecting portion defines the through-hole and has a planar surface that faces the first planar surface of the rectangular body of the anode supporting body.

The anode connecting portion may have wall members that are opposite the planar surface of the anode connecting portion and connected to the circumferential wall of the main body. The wall members define a prong end receiving cavity that is in communication with the aperture of the main body. The through-hole extends through the anode connecting portion to the prong end receiving cavity.

The resilient prong may have an end with flanged projections and the flanged projections are forced inwardly toward each other when the end of the resilient prong is inserted through the through-hole. The flanged projections resiliently move outwardly from each other when the end enters the prong end receiving cavity. The flanged projections extend past the through-hole and are engageable against at least one of the wall members of the anode connecting portion that defines the prong end receiving cavity.

A spacer element is used for supporting an anode member on a metallic reinforcement bar. The spacer element includes a main body having a circumferential wall that defines an aperture through which the metallic reinforcement bar is received. The circumferential wall has a first connecting portion and a second connecting portion that are adjacent. The first connecting portion and the second connecting portion are engageable and disengageable to contract and expand the circumferential wall respectively. The spacer element includes a fastening body that is connected to the main body and includes a first rib spaced radially outwardly from the first connecting portion of the circumferential wall to define a first teeth receiving slot between the first rib and the circumferential wall. The first rib has a first plurality of teeth extending radially inwardly from the first rib into the first teeth receiving slot and the second connecting portion of the circumferential wall has a second plurality of teeth that extends radially outwardly from the circumferential wall and is engageable with the first plurality of teeth. The fastening body includes a second rib spaced radially outwardly from the second connecting portion of the circumferential wall to define a second teeth receiving slot between the second rib and the circumferential wall. The first rib is reciprocally inserted into the second teeth receiving slot when the second connecting portion is inserted into the first teeth receiving slot. The spacer element includes an anode supporting body that is connectable to the main body and is configured to retain the anode member.

The spacer element may include a first ridge that radially extends into the first teeth receiving slot and is arranged on the first connecting portion or on the first rib. The second connecting portion is engageable against the first ridge in a first axial direction when the second connecting portion is inserted into the first teeth receiving slot, whereby the first ridge prevents further axial movement of the second connecting portion in the first axial direction. The spacer element may include a second ridge that radially extends into the second teeth receiving slot and is arranged on the second connecting portion or on the second rib. The first rib is engageable against the second ridge in a second axial direction opposite the first axial direction when the first rib is inserted into the second teeth receiving slot, whereby the second ridge prevents further axial movement of the first rib in the second axial direction.

A spacer element is used for supporting an anode member on a metallic reinforcement bar. The spacer element includes a bar supporting body having a wall that defines an aperture through which the metallic reinforcement bar is received and a through-hole therethrough, and an anode supporting body that is connectable to the bar supporting body. The anode supporting body includes a main body having a first planar surface facing the wall of the bar supporting body, and a second planar surface that opposes the first planar surface, a pivotable arm that is hinged to the second planar surface and is spaced from the second planar surface to define an anode receiving slot between the pivotable arm and the second planar surface, and a resilient prong that extends from the first planar surface toward the bar supporting body. The resilient prong is insertable through the through-hole and rotatable within the through-hole when inserted, whereby the anode supporting body is rotatable relative to the bar supporting body.

The second planar surface may have a ledge and the pivotable arm may have a hook that is disengageable and engageable with the ledge for opening and closing the anode receiving slot respectively. The anode member is inserted into the anode receiving slot when the hook is disengaged from the ledge and the anode receiving slot is open.

The second planar surface may have a ridge extending outwardly from the second planar surface and into the anode receiving slot to engage the anode member and prevent axial movement of the anode member.

Although the invention has been shown and described with respect to a certain embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A spacer element for supporting an anode member on a metallic reinforcement bar, the spacer element comprising:

a main body defining an aperture through which the metallic reinforcement bar is received, the main body having a circumferential wall and a plurality of resilient tines that extend radially inwardly from the circumferential wall into the aperture to engage the metallic reinforcement bar, the circumferential wall having a first connecting portion and a second connecting portion that are adjacent, the first connecting portion and the second connecting portion being engageable and disengageable to contract and expand the circumferential wall respectively, wherein the metallic reinforcement bar is radially insertable between the first connecting portion and the second connecting portion and into the aperture when the circumferential wall is expanded; and an anode supporting body that is connectable to the main body and is configured to retain the anode member.

2. The spacer element according to claim 1 further comprising a fastening body that is connected to the main body and has a first rib spaced radially outwardly from the first connecting portion of the circumferential wall to define a first teeth receiving slot between the first rib and the circumferential wall, wherein the first rib has a first plurality of teeth extending radially inwardly from the first rib into the first teeth receiving slot and the second connecting portion of the circumferential wall has a second plurality of teeth that extends radially outwardly from the circumferential wall, and wherein the second connecting portion is insertable into the first teeth receiving slot and the second plurality of teeth is engageable with the first plurality of teeth to close the circumferential wall.

3. The spacer element according to claim 2 further comprising a first ridge that radially extends into the first teeth receiving slot and is arranged on the first connecting portion or on the first rib, wherein the second connecting portion is engageable against the first ridge in one axial direction when the second connecting portion is inserted into the first teeth receiving slot, whereby the first ridge prevents further axial movement of the second connecting portion in the one axial direction.

4. The spacer element according to claim 2, wherein the first plurality of teeth is arranged along an entire length of the first teeth receiving slot.

5. The spacer element according to claim 2, wherein the fastening body has a second rib spaced radially outwardly from the second connecting portion of the circumferential wall to define a second teeth receiving slot between the second rib and the circumferential wall, and wherein the first rib is reciprocally inserted into the second teeth receiving slot when the second connecting portion is inserted into the first teeth receiving slot.

6. The spacer element according to claim 5 further comprising a second ridge that radially extends into the second teeth receiving slot and is arranged on the second connecting portion or on the second rib, wherein the first rib is engageable against the second ridge in one axial direction when the first rib is inserted into the second teeth receiving slot, whereby the second ridge prevents further axial movement of the first rib in the one axial direction.

7. The spacer element according to claim 5, wherein the second plurality of teeth is arranged along an entire length of the second teeth receiving slot.

8. The spacer element according to claim 2, wherein the fastening body and the main body are integrally formed as a unitary component.

9. The spacer element according to claim 1, wherein the anode supporting body has a resilient prong extending outwardly from the anode supporting body and toward the main body, and the main body defines a through-hole for receiving and retaining the resilient prong, wherein the resilient prong is rotatable within the through-hole, whereby the anode supporting body is rotatable relative to the main body.

10. The spacer element according to claim 9, wherein the anode supporting body further includes:

a rectangular body having a first planar surface from which the resilient prong extends outwardly toward the main body, and a second planar surface opposing the first planar surface; and a pivotable arm that is hinged to the second planar surface and is spaced from the second planar surface to define an anode receiving slot between the pivotable arm and the second planar surface.

11. The spacer element according to claim 10, wherein the second planar surface has a ledge and the pivotable arm has a hook that is disengageable and engageable with the ledge for opening and closing the anode receiving slot respectively, wherein the anode member is inserted into the anode receiving slot when the hook is disengaged from the ledge and the anode receiving slot is open.

12. The spacer element according to claim 10, wherein the second planar surface has a ridge extending outwardly from the second planar surface and into the anode receiving slot to engage the anode member and prevent axial movement of the anode member.

13. The spacer element according to claim 10, wherein the main body includes an anode connecting portion that extends radially outwardly from the main body toward the anode supporting body, and wherein the anode connecting portion defines the through-hole and has a planar surface that faces the first planar surface of the rectangular body of the anode supporting body.

14. The spacer element according to claim 13, wherein the anode connecting portion has wall members that are opposite the planar surface of the anode connecting portion and connected to the circumferential wall of the main body, wherein the wall members define a prong end receiving cavity that is in communication with the aperture of the main body, wherein the through-hole extends through the anode connecting portion to the prong end receiving cavity.

15. The spacer element according to claim 14, wherein the resilient prong has an end with flanged projections, the flanged projections being forced inwardly toward each other when the end of the resilient prong is inserted through the through-hole, the flanged projections resiliently moving outwardly from each other when the end enters the prong end receiving cavity, wherein the flanged projections extend past the through-hole and are engageable against at least one of the wall members of the anode connecting portion that defines the prong end receiving cavity.

16. A spacer element for supporting an anode member on a metallic reinforcement bar, the spacer element comprising:

a main body having a circumferential wall that defines an aperture through which the metallic reinforcement bar is received, the circumferential wall having a first connecting portion and a second connecting portion that are adjacent, the first connecting portion and the second connecting portion being engageable and disengageable to contract and expand the circumferential wall respectively;

a fastening body that is connected to the main body, the fastening body including:

a first rib spaced radially outwardly from the first connecting portion of the circumferential wall to define a first teeth receiving slot between the first rib and the circumferential wall, wherein the first rib has a first plurality of teeth extending radially inwardly from the first rib into the first teeth receiving slot and the second connecting portion of the circumferential wall has a second plurality of teeth that extends radially outwardly from the circumferential wall and is engageable with the first plurality of teeth; and a second rib spaced radially outwardly from the second connecting portion of the circumferential wall to define a second teeth receiving slot between the second rib and the circumferential wall, wherein the first rib is reciprocally inserted into the second teeth receiving slot when the second connecting portion is inserted into the first teeth receiving slot; and an anode supporting body that is connectable to the main body and is configured to retain the anode member.

17. The spacer element according to claim 16 further comprising:

a first ridge that radially extends into the first teeth receiving slot and is arranged on the first connecting portion or on the first rib, wherein the second connecting portion is engageable against the first ridge in a first axial direction when the second connecting portion is inserted into the first teeth receiving slot, whereby the first ridge prevents further axial movement of the second connecting portion in the first axial direction; and a second ridge that radially extends into the second teeth receiving slot and is arranged on the second connecting portion or on the second rib, wherein the first rib is engageable against the second ridge in a second axial direction opposite the first axial direction when the first rib is inserted into the second teeth receiving slot, whereby the second ridge prevents further axial movement of the first rib in the second axial direction.

18. A spacer element for supporting an anode member on a metallic reinforcement bar, the spacer element comprising:

a bar supporting body having a wall that defines an aperture through which the metallic reinforcement bar is received and a through-hole therethrough; and an anode supporting body that is connectable to the bar supporting body, the anode supporting body including:

a main body having a first planar surface facing the wall of the bar supporting body, and a second planar surface that opposes the first planar surface;

a pivotable arm that is hinged to the second planar surface and is spaced from the second planar surface to define an anode receiving slot between the pivotable arm and the second planar surface; and a resilient prong that extends from the first planar surface toward the bar supporting body, wherein the resilient prong is insertable through the through-hole and rotatable within the through-hole when inserted, whereby the anode supporting body is rotatable relative to the bar supporting body.

19. The spacer element according to claim 18, wherein the second planar surface has a ledge and the pivotable arm has a hook that is disengageable and engageable with the ledge for opening and closing the anode receiving slot respectively, wherein the anode member is inserted into the anode receiving slot when the hook is disengaged from the ledge and the anode receiving slot is open.

20. The spacer element according to claim 18, wherein the second planar surface has a ridge extending outwardly from the second planar surface and into the anode receiving slot to engage the anode member and prevent axial movement of the anode member.

* * * * *